United States Patent [19]

Juhanson

[11] Patent Number: 4,655,360

[45] Date of Patent: Apr. 7, 1987

[54] NON-SKID CASE

[76] Inventor: Juhannes Juhanson, 6 Donewen Court, Toronto, Ontario, Canada

[21] Appl. No.: 209,219

[22] Filed: Nov. 21, 1980

Related U.S. Application Data

[63] Continuation of Ser. No. 949,664, Oct. 10, 1978, abandoned, which is a continuation-in-part of Ser. No. 779,703, Mar. 21, 1977, abandoned.

[51] Int. Cl.[4] ..... B65D 1/24; B65D 21/02; B65D 25/24

[52] U.S. Cl. ..... 220/69; 206/201; 206/203; 206/427; 206/510; 220/21

[58] Field of Search ..... 220/21, 69; 206/201, 206/203, 427, 510

[56] References Cited

U.S. PATENT DOCUMENTS

| | | | |
|---|---|---|---|
| 2,821,327 | 1/1958 | Glazer | 206/203 |
| 2,974,819 | 3/1961 | Melville | 206/510 |
| 3,148,794 | 9/1964 | Cloyd | 220/21 |
| 3,265,237 | 8/1966 | Pache | 220/21 |
| 3,376,998 | 4/1968 | Cornelius | 206/203 |
| 3,490,583 | 1/1970 | Cook | 220/69 |
| 3,771,689 | 10/1973 | Mejan | 220/69 |
| 3,858,746 | 1/1975 | Hirota | 220/21 |
| 3,991,879 | 11/1976 | Hirota | 206/203 |
| 4,040,517 | 9/1977 | Torokvei | 206/203 |

FOREIGN PATENT DOCUMENTS

| | | | |
|---|---|---|---|
| 561351 | 4/1957 | Italy | 220/69 |
| 595955 | 12/1947 | United Kingdom | 220/69 |
| 895685 | 5/1962 | United Kingdom | 220/69 |
| 973724 | 10/1964 | United Kingdom | 220/21 |

*Primary Examiner*—George E. Lowrance

[57] ABSTRACT

A non-skid case for carrying packaged soft drinks and the like. The case has depressions in the lower surface of the bottom panel thereof which extend only partially through the bottom panel. The depressions are configured to entrap a portion of a high friction pad inserted therein to retain the pad, the pad forming a non-skid surface at the bottom of the case. Using this configuration, cases for carrying soft drinks may be molded in one piece using polyethylene and used on conveyor systems, etc. in place of wooden cases without sliding tendencies which are otherwise caused by the self-lubricating characteristics of polyethylene. Alignment of the pads in accordance with the ordered disposition of bottles in the case further enhances the stability of filled and stacked cases, with the lack of a through-hole in the region of the pad avoiding the local entrapment of syrups, etc., thereby avoiding any organic growth in that region. The lower surface of the case may be slotted so as to accommodate the handles of stackable bottle carriers. The slots are aligned so as to allow nesting of empty carriers and cases to reduce the volume for shipping and storage.

4 Claims, 19 Drawing Figures

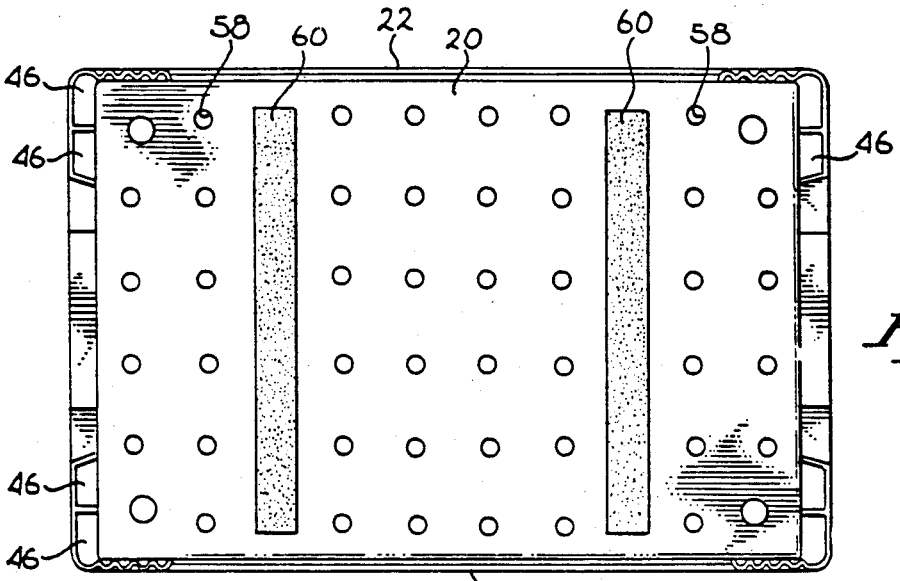
Fig. 4
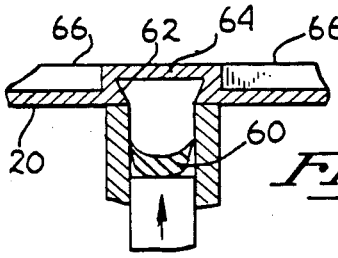
Fig. 8
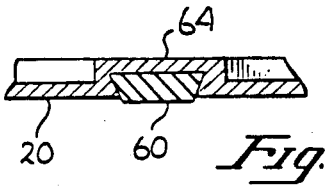
Fig. 7
Fig. 5
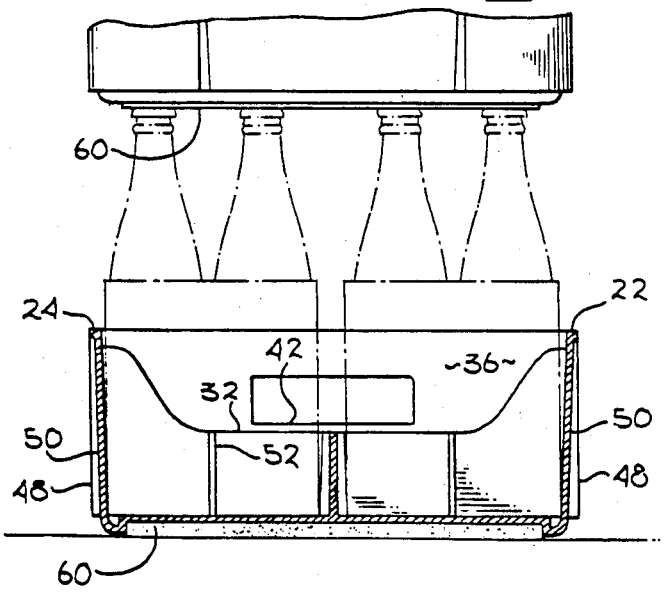
Fig. 6
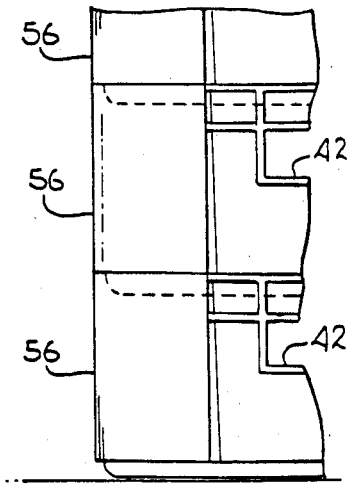

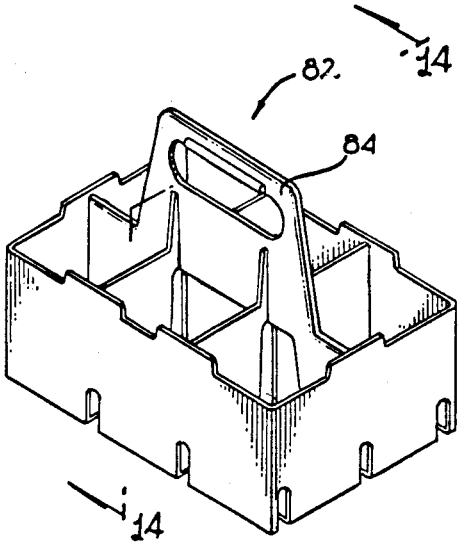
Fig. 12
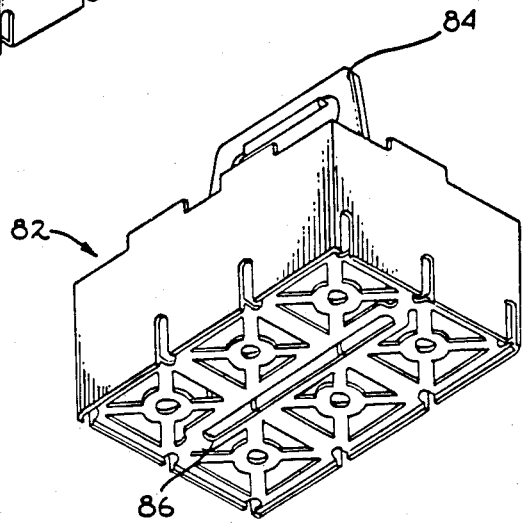
Fig. 13
Fig. 14
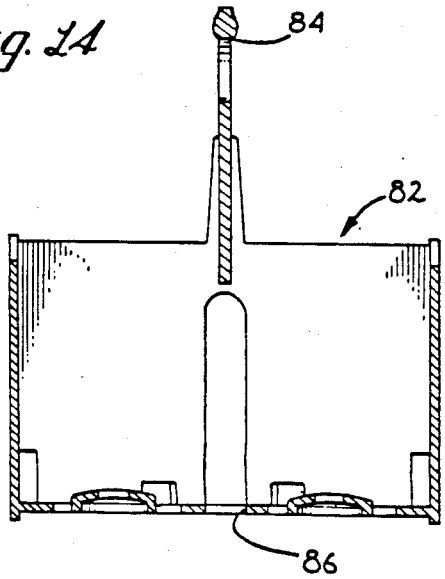

NON-SKID CASE

CROSS REFERENCES TO RELATED APPLICATIONS

This application is a continuation of application Ser. No. 949,664 filed Oct. 10, 1978, now abandoned, which is a continuation-in-part of application Ser. No. 779,703 filed Mar. 21, 1977, now abandoned.

BACKGROUND OF THE INVENTION

1. Field of the Invention

The present invention relates to the field of carrying cases.

2. Prior Art

Carrying cases are well known in the prior art. The present invention, however, is particularly suited for use in cases for soft drinks and the like, and is therefore described in detail herein with respect to a case for such purposes. Because the prior art and the problems related thereto with respect to soft drink cases is representative generally of the prior art and problems associated with cases for other purposes, the prior art described herein shall be limited to beverage cases, it being understood, however, that the present invention is not necessarily so limited.

Beverages have been commonly packaged in some form of carrier containing six individual beverage containers commonly referred to as a six-pack, though of course carriers of other quantities such as carriers containing eight containers of beverage are also commonly used. These carriers, whether of cardboard, plastic or other materials, are convenient for the consumer but are too small for efficient handling by bottlers and other persons in the distribution chain. Accordingly it is common practice to use cases for carrying a plurality of such carriers so as to provide more efficient handling of the product. Such cases, until recently, were generally fabricated from wood, with the associated equipment of the bottlers and those in the distribution chain, such as uncasers, casers, truck racks, etc. being sized to readily accept such cases.

In very recent years molded plastic cases have been used as substitutes for wooden cases, such plastic cases having the advantage of greater cost effectiveness. Given the considerations of cost, impact resistance and general appearance and durability, high density polyethylene is generally considered the preferred material for use in molding such cases. However polyethylene also exhibits very substantial self lubricating qualities, thereby giving rise to certain disadvantages to which the present invention is directed. In particular when cases of bottles are stacked, each case rests on the top of the bottles thereunder, with the self-lubricating characteristics of the polyethylene detracting from the general stability of the overall stack. Also the effective "slipperiness" of a polyethylene case when resting on a flat surface is generally undesirable, and in some cases may prohibit the use of such cases as a substitute for wooden cases. In particular cases are commonly handled at a bottling plant on conventional conveyor systems which may include transfer conveyors, etc., the successful operation of which depend upon adequate friction between the conveyor surface and the cases being conveyed thereby. Further, in many instances such conveyor systems include inclines, negotiation of which may require at least a minimum coefficient of friction between the case and the conveyor. Accordingly successful application of molded plastic cases in such instances requires the providing of suitable friction between the conveyor and the cases.

Accordingly in the prior art, efforts have been made to provide separate high friction members on the bottom of cases, such as rubber or high friction plastic feet so that the coefficient of friction of these feet rather than that of the polyethylene determines the driving force created by the conveyor. Typically in the prior art such feet were generally in the form of circular members inserted through through-holes in the bottom of the case, the feet having an enlarged head on both sides of the through-hole so as to be retained thereby. While the friction desired may be obtained in this manner, such an arrangement has certain specific disadvantages to which the present invention is directed. Since the feet are relatively local and are confined in position only by engagement with the edges of the holes, their durability is perhaps less than desired. Further, in the case of beverages, the existence of the through-hole in the bottom of the case with the elastic foot therein tends to entrap beverage syrup in the small gaps defined thereby, making cleaning of the inside of the case difficult, and promoting the growth of obviously undesired microorganisms.

The cases known prior to this invention did not provide for carrying stackable bottle carriers, particularly molded plastic carriers as disclosed, by way of example, by Torokvei in U.S. Pat. No. 4,040,517, issued Aug. 9, 1977, entitled "STACKING CASE". The prior art cases accommodate these new bottle carriers for stacking during shipping or storage in a conventional manner. In particular, the carrier handle extends above the sides of the prior art cases, with the prior art cases preventing nesting of the carriers and cases.

BRIEF SUMMARY OF THE INVENTION

A non-skid case for carrying packaged soft drinks and the like. The case has depressions in the lower surface of the bottom panel thereof which extend only partially through the bottom panel. The depressions are configured to entrap a portion of a high friction pad inserted therein to retain the pad, the pad forming a non-skid surface at the bottom of the case. The bottom panel of the carrying case may be slotted to accommodate stackable bottle carriers. When the cases are appropriately slotted, stackable carriers and cases can be nested together when stacked to reduce the volume for shipping or storage. Using these configurations, cases for carrying soft drinks may be molded in one piece using polyethylene and used on conveyor systems, etc. in place of wooden cases without sliding tendencies which are otherwise caused by the self-lubricating characteristics of polyethylene. Alignment of the pads in accordance with the ordered disposition of bottles in the case further enhances the stability of filled and stacked cases, with the lack of a through-hole in the region of the pad avoiding the local entrapment of syrups, etc., thereby avoiding any organic growth in that region. In the specific embodiments disclosed the depressions in the lower surface of the bottom panel are simple wedge-shaped depressions of substantially uniform cross section running across most of the width of the case, with the nonself-lubricating member or pad being a molded flexible vinyl chloride strip. Slotted cases have slots running perpendicular to the depressions, but do not pass through to the region of the depression, thereby preventing the formation of difficult-to-clean gaps wherein undesired microorganisms would otherwise grow.

BRIEF DESCRIPTION OF THE DRAWINGS

FIG. 4 is a bottom view taken along line 4—4 of FIG. 3.

FIG. 5 is an illustration of a stack of filled cases in accordance with the present invention, the lower case being shown in partial cross section.

FIG. 6 is a view illustrating the stacking of empty cases.

FIG. 7 is a view taken on an expanded scale along line 7—7 of FIG. 3.

FIG. 8 is a schematic illustration of the manner of insertion of members 60 into the depressions in the bottom of the case.

FIG. 12 is a top perspective view of a type of bottle carrier that the case of FIG. 9 is intended to carry.

FIG. 13 is a bottom perspective view of the bottle carrier of FIG. 12.

FIG. 14 is a cross sectional view taken along line 14—14 of FIG. 12.

DETAILED DESCRIPTION OF THE INVENTION

Figure 1:
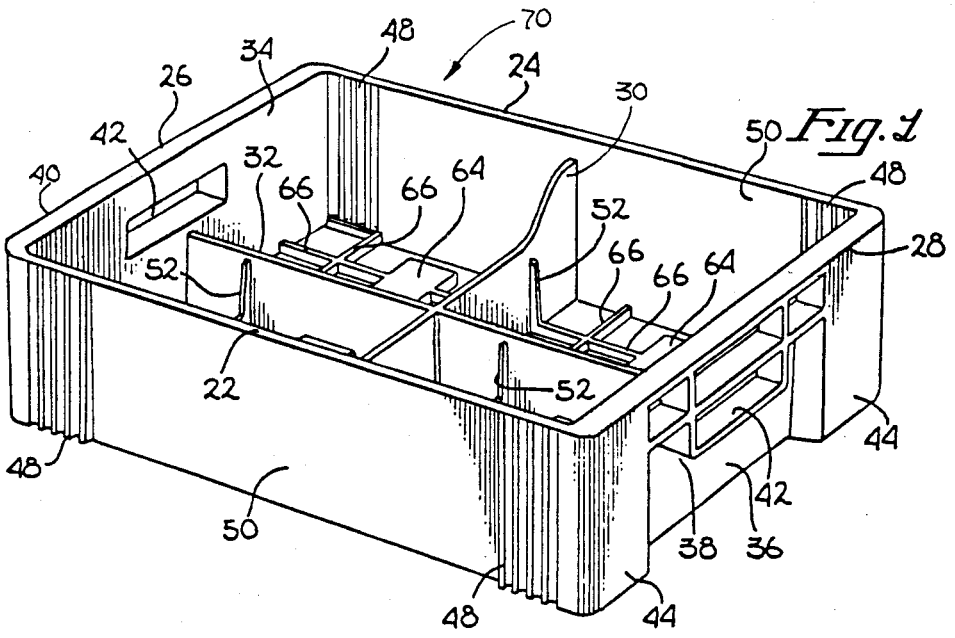
FIG. 1 is a perspective view of one embodiment of the present invention.

First referring to FIG. 1, a case 70 fabricated in accordance with the present invention may be seen. The particular case illustrated is intended for carrying four six-packs of soft drinks. In the embodiment shown the case is comprised of a bottom panel 20 coupled at its periphery to sides 22 and 24 and end members 26 and 28, forming the basic case enclosure. Also disclosed within the case are lateral and longitudinal dividers 30 and 32, respectively, for dividing the enclosure into four portions, each for receiving one six-pack. Since the case shown is used as a replacement for prior art wooden cases, various portions of the various plastic panels are thickened by ribs and/or hollow sections which both simulate the thickness of the wood without using a corresponding amount of plastic material, and provide stiffening and other functional advantages as the result thereof. By way of example, the ends 26 and 28 have inwardly positioned end panels 34 and 36 with reinforcing webs such as webs 38 and 40, with handle openings 42 being defined by such webs. Also the corner regions 44 defining the overall length of the case have hollow regions 46, as may be seen in the bottom view of the case of FIG. 4. Similarly, the side panels 22 and 24 are provided with regions 48 to provide an apparent thickness of the side panel substantially greater than the actual thickness of the material at that location, allowing for the slight recessing of the center side panel regions 50 so as to provide some protection for advertising material, etc. commonly applied to such area. Similarly, even the dividers 30 and 32 are provided with small rib-like projections 52 to simulate the thicker wood dividers characteristic of wood cases. The apparent thickening of the side and end panels, however, is not carried quite to the bottom of the case, so that the smaller base region, generally indicated by the numeral 54 in FIG. 3, will interfit with another case, as illustrated in the stack of cases 56 in FIG. 6.

In the preferred embodiment the case enclosure so far described is a one piece injection molded part of high density polyethylene. As such the case is tough, durable and quite cost effective when compared to wooden cases. However, the self lubricating characteristics of polyethylene provide limitations on the use of such a case as a direct replacement for wood cases in many applications because of polyethylene's tendency to slide on conveyors, thereby interfering with the normal function of some conveyor systems. Accordingly in the present invention, inserts of a suitable material not exhibiting self lubricating characteristics are provided on the bottom of the case so that these members will engage any substantially flat surface such as a conveyor belt, truck bed, etc. when the case is disposed on such a surface. In that regard the phrase "a material not exhibiting self lubricating characteristics" is intended to refer to material other than material such as teflon, nylon, delrin, etc. which exhibit unusually low coefficients of friction when in contact with most materials. Since the friction sought to be created by the present invention need only be comparable to that of wood, a great number of materials potentially may be used. However, as shall subsequently be seen, it is preferable that the material selected be elastic so that it may be temporarily deformed for assembly to the case enclosure and, of course, other considerations of cost, etc. favor certain materials over other materials. Based on these considerations the preferred material for such use is a flexible vinyl chloride which provides a relatively high coefficient of friction when in contact with most materials, is sufficiently elastic for assembly as required, and is relatively inexpensive and durable for such purpose.

Figure 2:
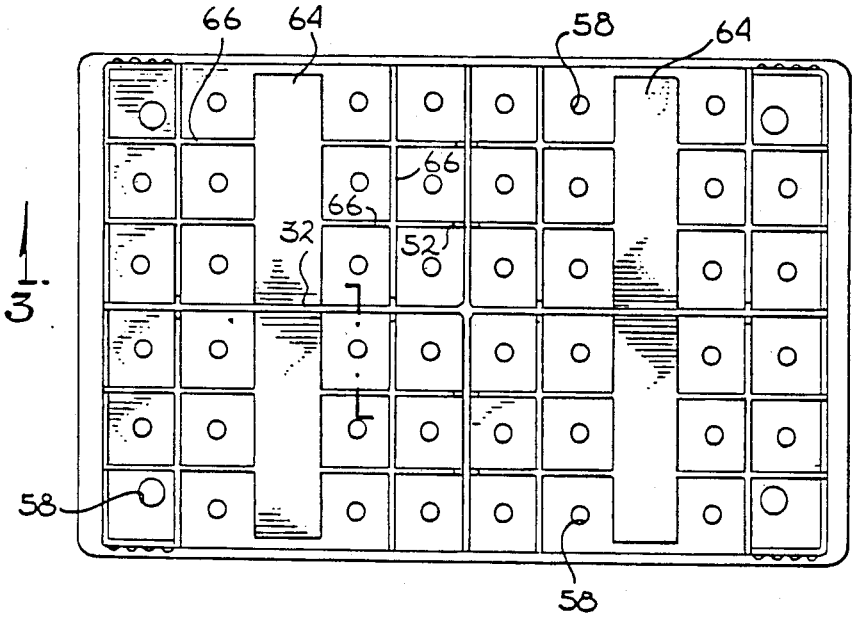
FIG. 2 is a top view of the embodiment of FIG. 1.
Figure 3:
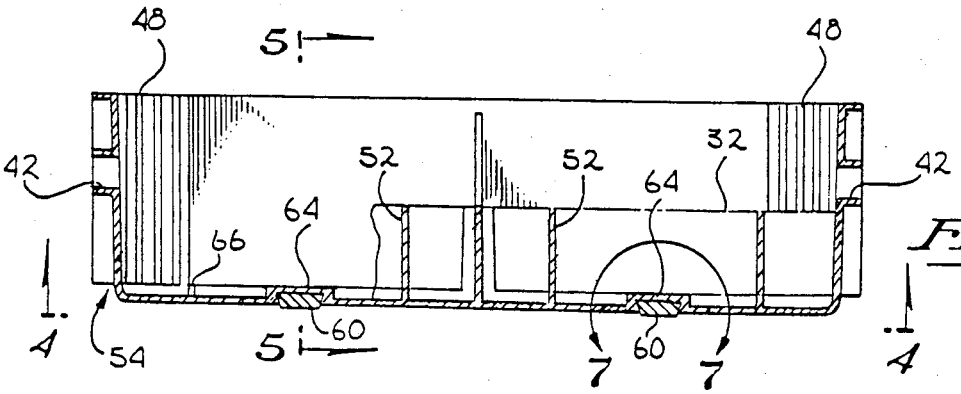
FIG. 3 is a cross sectional view taken along line 3—3 of FIG. 2.

Now referring to FIG. 4, a bottom view of case 70 of FIG. 1 may be seen. Aside from the bottom surface of bottom panel 20 which is provided with a plurality of through-holes 58 to provide fluid drainage therefrom, and secondarily to reduce the amount of material required, the vinyl chloride members 60 may also be seen. It will be noted that in the preferred embodiment these members extend a substantial portion of the distance between the side walls 22 and 24, though terminate short of the edges of the case. Further it will be noted that members 60 are substantially coterminous with the depressions in the bottom of case 20 in which they are disposed. In particular, FIG. 3 provides a cross section taken along line 3—3 of FIG. 2, with FIG. 7 taken along line 7—7 of FIG. 3 showing the cross section of a member 60 and an adjacent portion of the case bottom panel 20 taken on an expanded scale. As may be seen in FIG. 3 and more easily in FIG. 7, the bottom panel 20 contains depressions in the bottom surface thereof containing members 60, the depressions in the preferred embodiment extending over a substantial portion of the width of a case and being in the form of a tapered groove having a base region which is substantially larger than the mouth region thereof. The depressions in the preferred embodiment are substantially uniform across the width of the case, with the members 60 disposed therein being substantially coterminous therewith. It will be noted that the depressions within which the members 60 fit do not extend the full width of the case, and accordingly members 60 may not simply be slipped into position from the side of the case during assembly, or more importantly inadvertently slipped out in use. Accordingly in the preferred embodiment, members 60 are made from an elastic material (vinyl chloride) so that it may be compressed from the side by an appropriate tool, shown schematically in FIG. 5, for quick insertion into the depression or slot 62.

Members 60 extend below the bottom surface of the bottom panel 20 so as to engage any flat surface on which the case may be resting, as shown in FIG. 5. Whether the entire case weight is supported by members 60 is a question of design choice, as the flexibility of the member coupled with the flexibility of a polyethylene case generally allows part of the weight of the case to be supported by the direct contact of the polyethylene with the supporting surface. In addition in the preferred embodiment members 60 are generally aligned with the normal bottle or container orientation in the case so that when cases filled with beverage containers are stacked as shown in FIG. 5, members 60 will engage the tops of the containers, thereby substantially enhancing the stability of the stack.

It will be noted that there are no through-holes in the region of the members 60, the members fitting within the shaped depressions in the bottom panel. (Molding of these depressions may readily be accomplished by using a three-piece mold insert for each depression, two of the pieces forming each tapered side wall, with the third central piece completing the depression, so that the central piece may be first removed to allow collapsing together of the two side pieces prior to withdrawal from the molded part.) Provision for the depressions, however, does not increase the thickness of the base of the case, or for that matter provide any nonuniformity in the height of the support surface for the containers placed therein. In particular it will be noted in FIGS. 1, 2 and 8 that the upper surface of the base panel 20 is characterized by sections 64 in the region of the vinyl chloride members 60, and in other regions by a plurality of reinforcing webs 66. Accordingly no through-holes exist in the region of the friction enhancing members so that no organic materials may accumulate in such a region on the top surface of the bottom panel. Further, the friction inducing members are retained not merely by a circular pad passing through a hole in the case bottom but by fitting within an appropriately shaped depression in the case bottom whereby vertical force thereon merely encourages the friction member further into the retaining slot rather than through the retaining hole. Because of the proportions of the retaining slot and friction member a much larger retaining area is achieved with the present invention in comparison to round friction inducing members retained by through-holes. In that regard it should be noted that the friction inducing members of the present invention have a somewhat curved bottom surface so that the edges thereof are approximately flush with the adjacent bottom surfaces of the case so as to eliminate any opportunity for a sharp corner on a conveyor hand truck, etc. from getting under members 60 to encourage them out of their retaining pocket.

Figure 9:
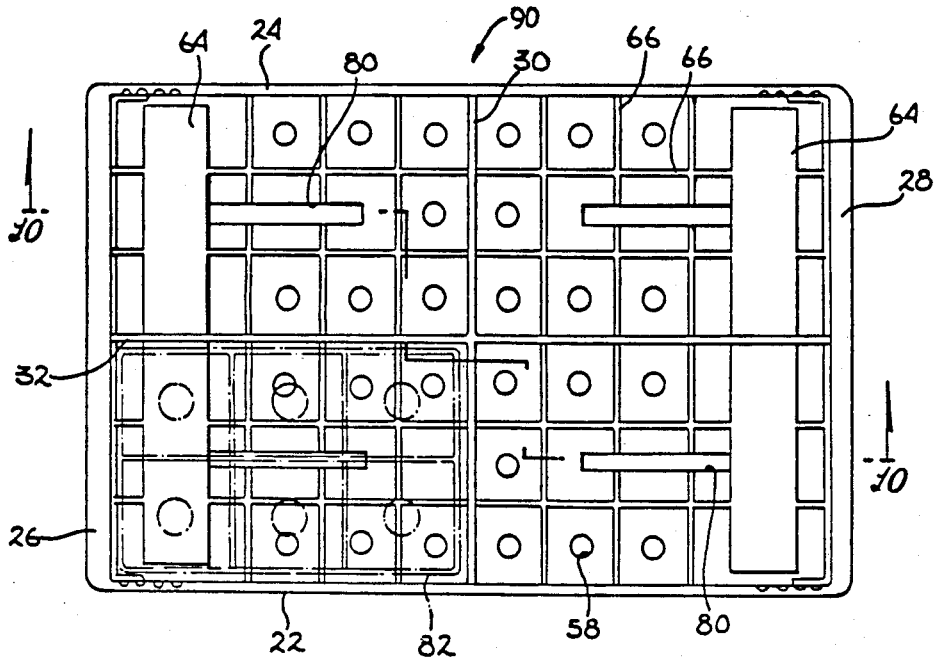
FIG. 9 is a top view of another embodiment of the present invention.
Figure 10:
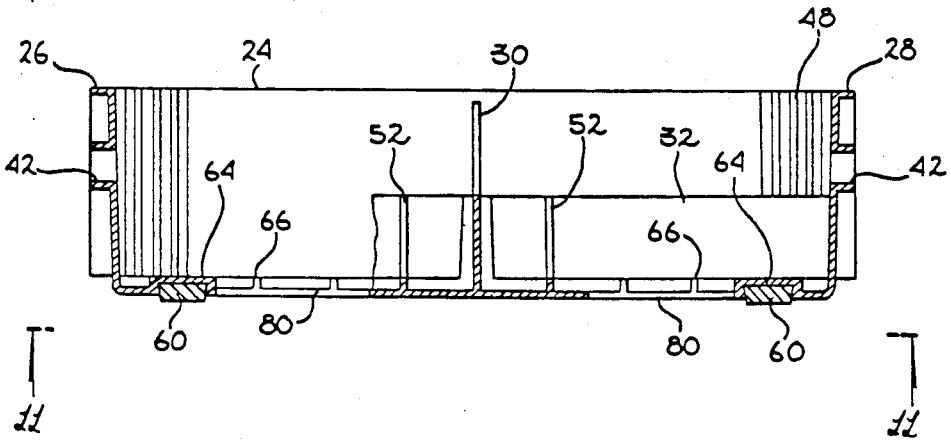
FIG. 10 is a cross sectional view taken along line 10—10 of FIG. 9.
Figure 11:
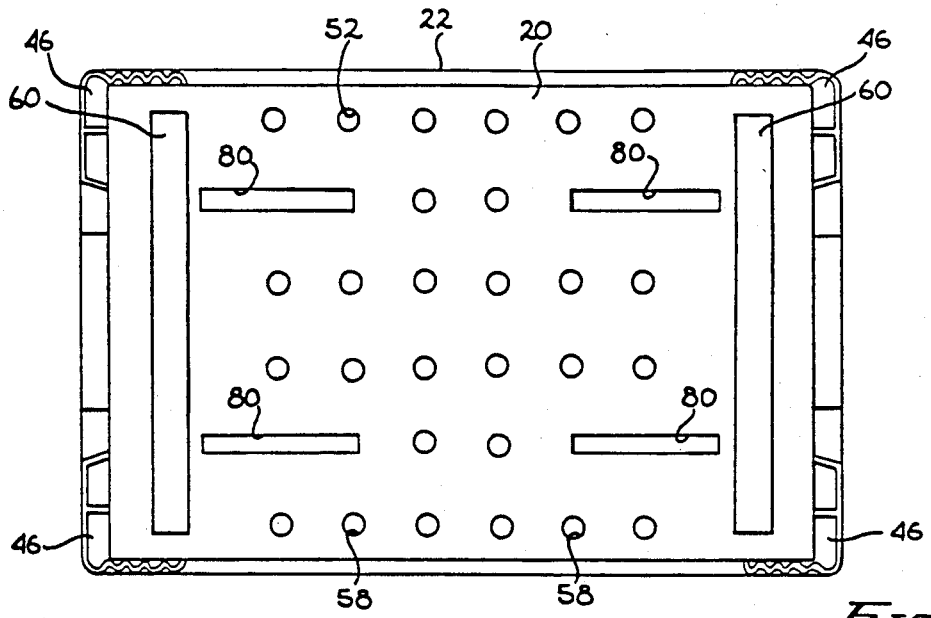
FIG. 11 is a bottom view of the embodiment illustrated in FIG. 9 taken along line 11—11 of FIG. 10.

FIG. 9 is an illustration of another embodiment of cases fabricated in accordance with the present invention. The case 90 is almost identical with case 70 of FIG. 1 and the members common to these cases have been identified with identical numbers. Case 90 is intended to carry stackable bottle carriers, such as carrier 82 shown in phantom lines in case 90 in the lower left hand corner of FIG. 9. The cases of FIGS. 1 and 9 differ in that case 90 is slotted with slots 80 so that the handles of stackable carriers can be accommodated. Also members 60 and the depressions in which they are disposed are positioned closer to end panels 26 and 28, as clearly shown in FIG. 10, to allow for the proper positioning of slots 80. Slots 80 and members 60 are positioned as shown in FIG. 11 so that no gaps adjacent members 60 are created where cleaning would be difficult, thereby preventing the growth of undesired microorganisms in the internal region of the case.

Figure 17:
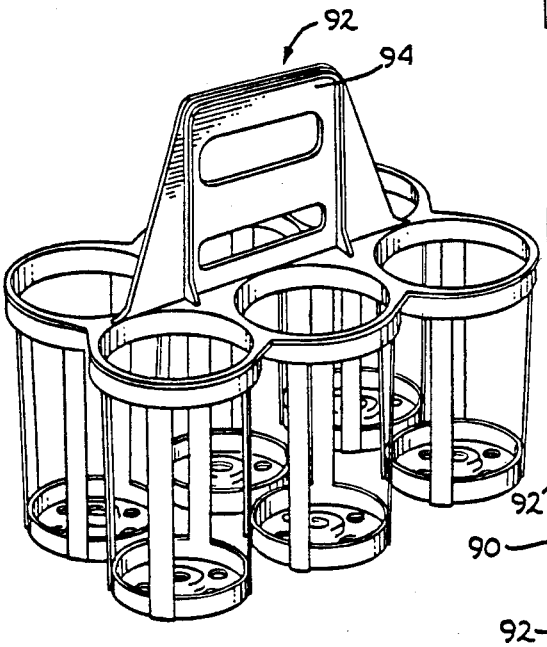
FIG. 17 is a perspective view of another type of bottle carrier that the case of FIG. 9 is intended to carry.

Case 90 is particularly intended to hold the recently developed stackable molded plastic carriers such as, by way of example, have been manufactured by the assignee of the present invention and illustrated as carrier 92 in FIG. 17, and as disclosed by Torokvei in U.S. Pat. No. 4,040,517 and illustrated as carrier 82 in FIGS. 12, 13 and 14. (This patent is also owned by the assignee of the subject invention.) Because these carriers are of one piece molded plastic construction, they are light weight and strong. They do not deteriorate and therefore can be reused for an indefinite period of time. Because they are easily stackable, handle 84 fitting through carrier slot 86, they occupy relatively little room for shipping and storage.

Figure 15:
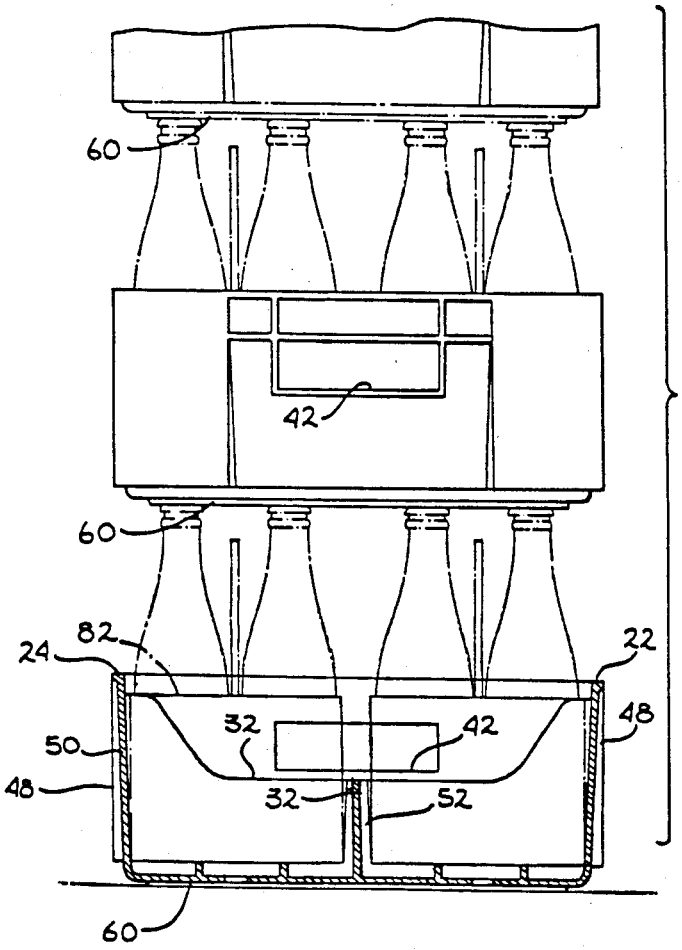
FIG. 15 is an illustration of a stack of cases of the embodiment shown in FIG. 9 filled with carriers of FIG. 12, which in turn are filled with bottles, the lowest case being shown in partial cross section.
Figure 18:
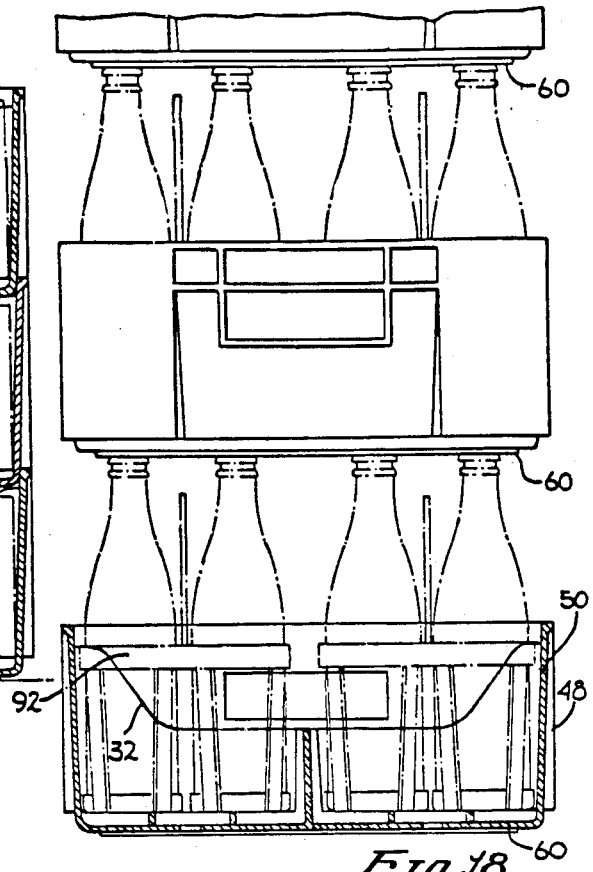
FIG. 18 is an illustration of a stack of cases of the embodiment shown in FIG. 9 filled with the carriers of FIG. 17, which in turn are filled with bottles, the lowest case being shown in partial cross section.

As with case 70, members 60 of case 90 are generally aligned with the normal bottle or container orientation in the case so that when cases filled with beverage containers in Torokvei carriers are stacked as illustrated in FIG. 15, members 60 will engage the tops of the containers, thereby enhancing the stability of the stack. Since the bottle positions are set by the case generally, the same general case configuration can be used with other carriers, as shown in FIG. 18.

Figure 16:
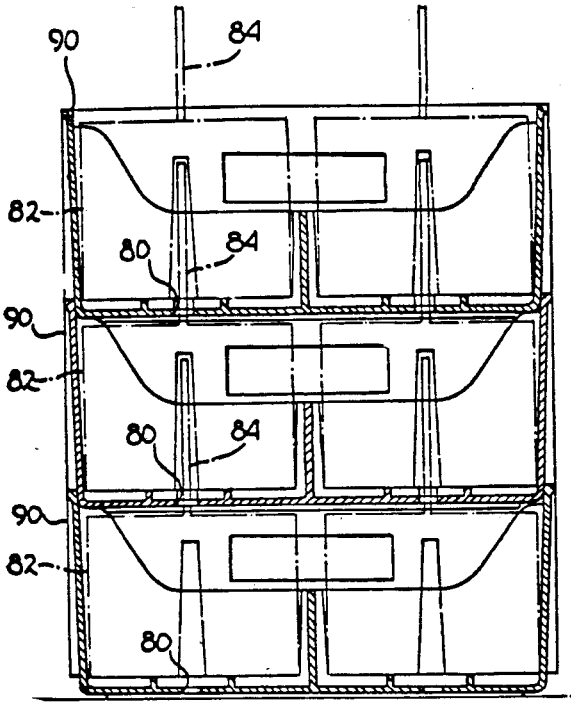
FIG. 16 is a cross sectional view illustrating the stacking of cases of the embodiment shown in FIG. 9 filled with empty bottle carriers of FIG. 12.
Figure 19:
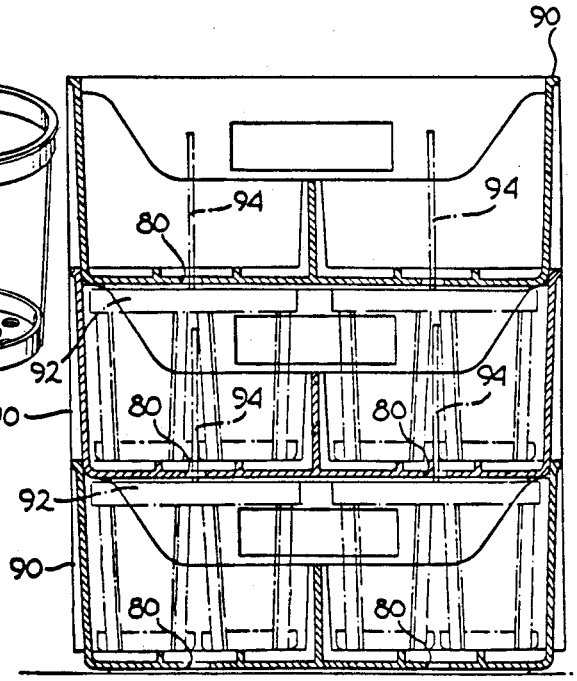
FIG. 19 is a cross sectional view illustrating the stacking of cases of the embodiment shown in FIG. 9 filled with empty bottle carriers of FIG. 17.

The slots 82 of case 90 are aligned so that they can receive the handles 84 (or 94) of stackable carriers so that the case and empty carriers can be nested together during shipping and storage. As shown by FIGS. 16 and 19, with carriers 82 and carriers 92 respectively illustrated by phantom lines, cases 90 can be stacked while full of empty carriers and take up no more room than completely empty cases.

The present invention has been described in detail herein with respect to beverage cases, with the specific embodiment disclosed being a half depth case (e.g., a case having a height substantially less than the containers intended to be carried thereby) though obviously the invention may also be applied to full depth cases. Further, it is to be understood that it may also be applied to other molded plastic cases and particularly polyethylene cases wherein it is necessary or desirable to enhance the friction between the case and a surface on which it may rest. Obviously other materials for friction member 60, other complimentary shapes between friction member 60 and the adjacent depression 62 may be used, etc. depending upon the particular application and the preference of the designer. Accordingly while the present invention has been disclosed and described with respect to a preferred embodiment thereof, it will be understood by those skilled in the art that various changes in form and detail may be made therein without departing from the spirit and scope thereof.

I claim:

1. In a plurality of injection molded plastic cases resting on substantially flat surfaces, each of said cases comprising a one piece injection molded plastic case enclosure having a bottom panel, first and second side panels and first and second end panels, the ends of said first and second side panels being coupled to the adjacent ends of said first and second end panels and the lower portion of said first and second end panels and said first and second side panels being coupled to respective edges of said bottom panel to form said case enclosure, said case enclosure being of sufficient size and shape to accommodate a plurality of carriers, said carriers each comprised of a one piece injection molded polyethylene member having a body adapted to receive a plurality of containers and a handle which extends above the body of said carrier, said body of said carrier being adapted to receive the handle of another carrier for stacking, the improvements comprising:

at least one depression molded in the lower surface of the bottom panel, said at least one depression extending over a substantial portion of a first dimension of said bottom panel, said depression being in the form of a tapered groove having a base region which is substantially larger than a mouth region thereof;

at least one elastic friction member coterminous with said at least one depression to prevent dislodgement therefrom, said elastic friction member extending below the bottom panel to engage the flat surface on which the case may be resting; and a plurality of slots in said bottom panel being a size and shape to accommodate the handles of the carriers and aligned with the normal position the carriers are inserted in the case;

whereby a plurality of cases filled with empty carriers can be nested together by inserting the handles of the carriers into the slots of the case placed thereover thereby occupying a smaller volume during shipping and storage and whereby said elastic friction members will not slide on the flat surface whether the containers are empty or filled when subject to transverse or sliding forces.

2. The cases of claim 1, wherein said elastic friction member has a curved bottom surface substantially flush with the adjacent surface of the bottom panel.

3. The cases of claim 1 wherein said depression is positioned adjacent to said end panel perpendicular to said plurality of slots.

4. The cases of claim 1 wherein said depression does not extend through said bottom panel.

* * * * *